US006261418B1

(12) United States Patent
Stotz et al.

(10) Patent No.: US 6,261,418 B1
(45) Date of Patent: Jul. 17, 2001

(54) HEADBOX WITH FLEXIBLE SUPPORT PLATES

(75) Inventors: Wolf Gunter Stotz, Ravensburg; Thomas Merath, Weingarten; Klaus Lehleiter, Mengen; Christoph Link, Weingarten; Josef Frey, Ravensburg; Eckart Krägeloch, Heidenheim; Thomas Dietz, Königsbronn; Simon Juhas, Nattheim; Jürgen Banning, Düren, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/411,659

(22) Filed: Oct. 4, 1999

(30) Foreign Application Priority Data

| | | |
|---|---|---|
| Oct. 5, 1998 | (DE) | 198 45 722 |
| Oct. 5, 1998 | (DE) | 298 23 639 |
| Jun. 15, 1999 | (DE) | 199 27 241 |

(51) Int. Cl.[7] ..... D21F 1/02
(52) U.S. Cl. ..... 162/336; 162/344
(58) Field of Search ..... 162/336, 343, 162/344, 347, 272

(56) References Cited

U.S. PATENT DOCUMENTS

| | | | | |
|---|---|---|---|---|
| 1,775,905 | | 9/1930 | Lang | 162/344 |
| 3,309,264 | * | 3/1967 | Parker et al. | 162/336 |
| 3,313,681 | | 4/1967 | Dennis et al. | 162/252 |
| 3,977,938 | * | 8/1976 | Descary et al. | 162/336 |
| 4,406,741 | * | 9/1983 | Kirgavaihen | 162/336 |
| 4,923,569 | | 5/1990 | Nyman et al. | 162/339 |
| 5,304,285 | | 4/1994 | Meinecke et al. | 162/343 |
| 5,565,064 | * | 10/1996 | Grimm et al. | 162/336 |

FOREIGN PATENT DOCUMENTS

| | | | |
|---|---|---|---|
| 3628699 | 3/1988 | (DE) . | |
| 3723922 | 1/1989 | (DE) . | |
| 4106764 | 8/1992 | (DE) . | |
| 323468 | 6/1990 | (EP) . | |
| 631011 | 12/1994 | (EP) . | |
| 1145299 | * 12/1966 | (GB) | 162/344 |
| 1595560 | 8/1981 | (GB) . | |

* cited by examiner

*Primary Examiner*—Karen M. Hastings
(74) *Attorney, Agent, or Firm*—Greenblum & Bernstein, P.L.C.

(57) ABSTRACT

Headbox for a paper-making machine including a nozzle extending transversely to the machine running direction across the machine width. The nozzle has a lower and an upper continuous wall each extending across the machine width. The lower nozzle wall is supported by several separate supporting elements distributed across the machine width on a foundation. The supporting elements are non-rigid or flexible plates to permit bending in a direction transversely to the machine running direction. Alternatively or additionally, a swivelable or pivotable upper nozzle wall is connected by several separate supporting members distributed across the machine width to a transverse bar attached above a swivel axis. The supporting members are non-rigid or flexible plates to permit bending transversely to the machine running direction. Alternatively or additionally, an upper arm and a central part of a central component of the headbox are each segmented transversely to the machine running direction, while an inlet-side central part of the central component and the lower nozzle wall are each designed to be continuous transverse to the machine running direction.

27 Claims, 5 Drawing Sheets

HEADBOX WITH FLEXIBLE SUPPORT PLATES

CROSS-REFERENCE TO RELATED APPLICATIONS

The present application claims priority under 35 U.S.C. §119 of German Patent Application Nos. 199 27 241.7, filed Jun. 15, 1999, and 298 23 639.7, filed Oct. 5, 1998, the disclosures of which are expressly incorporated by reference herein in their entirety. The present application further claims priority under 35 U.S.C. §119 of German Patent Application No. 198 45 722.7, filed Oct. 5, 1998.

BACKGROUND OF THE INVENTION

1. Field of the Invention

The present invention relates to a headbox for a papermaking machine with a nozzle extending transverse to the machine running direction across the machine width. The headbox has a lower and an upper continuous wall each extending across the machine width.

2. Discussion of Background Information

In conventional headboxes of the type mentioned above, the lower nozzle wall is normally supported by a run-in table provided as a continuous weldment. However, deviations from the desired parallelism in the outlet gap can occur due to the effect of thermal expansion caused by the temperature of the material.

In a headbox as described in German patent DE 41 06 764 A1, the upper nozzle wall is connected to a rigid girder by rods that are flexible to bending.

SUMMARY OF THE INVENTION

The invention resides in creating a headbox of the type mentioned above which continuously guarantees as parallel an outlet gap as possible practically independently of the respective operating conditions, having the most cost-effective design possible, simple operation, and minimal maintenance expense.

In a headbox according to the invention, the lower nozzle wall is supported by several separate supporting elements distributed across the machine width on a foundation. These supporting elements are designed to be non-rigid or flexible to bending transverse to the machine running direction.

As a result, a transverse bar provided directly on the lower nozzle wall is eliminated. This also prevents the lower nozzle wall from bending with a non-uniform change in temperature. The supporting elements essentially carry the entire headbox. In the case of a temperature-induced change in length of the lower nozzle wall, these supporting elements give way correspondingly in a direction transverse to the machine running direction. The lower nozzle wall remains sufficiently even in the case of a change in temperature and/or pressure. Therefore, the heating system that compensates for the thermal bending of the lower nozzle wall that has been conventional until now can be eliminated.

The individual supporting elements can extend at least to some degree in a generally vertical manner, i.e., perpendicular to the lower nozzle wall.

According to the invention, the individual supporting elements are formed at least partially by disks, i.e., stud bolts or the like, extending parallel to the machine running direction.

The individual supporting elements can be connected directly to the foundation by a base plate and/or a pedestal.

In addition, the supporting elements can be connected to the lower nozzle wall, for example.

In another suitable embodiment, in which the lower nozzle wall can be displaced on a stationary supporting plate in the machine running direction, the supporting elements are connected to the supporting plate.

In order to guarantee the most stable positioning of the lower nozzle wall possible and to prevent undesired lateral oscillations, at least one diagonal or transverse brace is provided suitably in a center area, as viewed transverse to the machine running direction, between successive supporting elements.

Another alternative solution according to the invention or one in combination with the preceding solution of the above objective includes a headbox of the type mentioned previously in which the upper nozzle wall can be swiveled around an axis extending transverse to the machine running direction and is connected by several separate supporting members, distributed across the machine width, with a transverse bar attached above the swivel axis. These supporting members are to be non-rigid or flexible to bending transverse to the machine running direction (see claim 10).

As a result, no transverse bar is provided directly on the upper nozzle wall. Regardless of the respective changes in temperature and/or pressure, it is thus assured that the upper nozzle wall remains sufficiently even.

The headbox can be provided in particular with a central component which includes a lower arm formed by the lower nozzle wall or the supporting plate allocated to the nozzle, an upper arm that is preferably parallel to the nozzle, an inlet-side first central part and a second central part behind the first central part in the machine running direction. The upper arm and the two central parts are arranged between this upper arm and the lower arm preferably forming supporting members of a turbulence generator. In this connection, it is conceivable, for example, that the transverse bar be connected to the central component by at least one stroke element and no more than three stroke elements, and in particular by only one stroke element or by two stroke elements.

In a suitable practical embodiment of the headbox according to the invention, the individual supporting members extend at least to some extent in a generally vertical manner, i.e., perpendicular to the upper nozzle wall.

The individual supporting members are preferably formed at least partially by disks parallel to the machine running direction.

The transverse bar can be formed by sheet metal standing on edge or by a hollow beam.

In a headbox according to the invention, provisions are made for the upper arm and the rear or downstream second central part of the central component to each be segmented transverse to the machine running direction. The inlet-side first central part of the central component and the lower nozzle wall are each designed to be continuous transverse to the machine running direction.

The central component is thus formed by a partially segmented C-shaped clamp, where basically only those parts bordering the material guiding areas are not segmented, i.e., are formed continuously in the crosswise direction.

This third solution according to the invention can also be provided alternatively or in combination with the two previous solutions according to the invention. If in combination with the two previous solutions, both a combination with the first or second solution as well as a combination of all three solutions are conceivable.

If the lower nozzle wall is displaced on a stationary supporting plate in the machine running direction, then it is preferred that the stationary supporting plate also be segmented transverse to the machine running direction.

If, for example, the upper nozzle wall is swiveled by a hinge around an axis extending transverse to the machine running direction, then preferably a continuous hinge bearing is provided extending transverse to the machine running direction on the rear or downstream end of the upper arm of the central component in the machine running direction. This hinge bearing can always have a material reduction in the area between the individual segments of the adjacent upper arm.

In a practical embodiment, the division of the segments of the upper arm of the central component defined by the distances from segment center to segment center is equal to the division of the segments of the rear or downstream second central part of the central component.

It is also advantageous for the division of the supporting elements and the supporting members defined by the distances from element or member center to element or member center to be equal to the division of the segments of the central component.

According to the invention, the parallelism of the outlet gap can be assured under substantially all operating conditions that are possible in practice. Accordingly, deformations of the upper and the lower nozzle wall under varying pressure in the nozzle and/or under varying material temperature are at least essentially excluded. If the nozzle walls are pressed apart under hydrostatic pressure during operation, the resulting expansion forces are transmitted rather uniformly across the machine width by way of the cited numerous supporting elements or the supporting members. A deflection of the nozzle walls is, therefore, avoided. In addition, an extremely cost-effective design is realized, i.e., particularly lower expenses for material and manufacture (such as processing) as well as for control and regulation equipment. Lower expenses for maintenance are also achieved along with simpler handling during operation.

The dimensions of the component cross-section can be equal for different headboxes with different machine widths. This simplifies the creation of drawings and manufacture. Only the supporting elements have to be dimensioned according to the maximum pressure prevailing in the nozzle.

The use of a lower nozzle wall that can be displaced in the machine running direction makes it possible to vary the direction of the material stream without needing to swivel the entire headbox. This results in considerably lower expenses for construction. Otherwise, each of the supporting elements would have to rest on the foundation in a pivoting bearing. This also applies to a headbox for an endless wire former as well as to a headbox for a twin wire former.

One or more, e.g., two, hydraulic cylinders and linear stroke flow dividers can be provided as the drive for this type of displaceable lower nozzle wall. In this connection, MLH series linear stroke flow dividers made by the company Jahns-Regulatoren GmbH, located in D-63069 Offenbach, Germany, can be used, as they were described in a corresponding Jahns-Regulatoren GmbH publication in March 1997. One or two additional hydraulic cylinders can be provided in the center area in the case of greater machine widths.

According to the invention, there is provided a headbox for a paper-making machine comprising a nozzle extending transversely to a machine running direction, across a machine width. The nozzle has a lower and an upper continuous wall, each extending across the machine width. Several separate supporting elements are distributed across the machine width on a foundation for supporting the lower wall on the nozzle. The supporting elements are non-rigid.

The supporting elements are flexible to permit bending in a direction transverse to the machine running direction and extend at least to some extent vertically, and perpendicularly to the lower nozzle wall. The individual supporting elements comprise, at least partially, disks, stud bolts, or the like, disposed in a direction parallel to the machine running direction. The supporting elements are connected directly to the foundation. Alternatively, the supporting elements are connected to the foundation by at least one of, a base plate or a pedestal. The supporting elements are connected to the lower wall of the nozzle.

According to the invention, the lower wall of the nozzle is moveable on a stationary supporting plate in the machine running direction and the supporting elements are connected to the supporting plate. At least one of, a diagonal brace or transverse brace are provided between successive supporting elements in a center area, as viewed in a direction transverse to the machine running direction.

The upper wall of the nozzle is pivotable around a swivel axis extending transversely to the machine running direction, and further comprises a transverse bar attached above the swivel axis. Several separate supporting members are distributed across the machine width. The supporting members connect the upper wall with the transverse bar. The supporting members are non-rigid and may be flexible to permit bending in a direction transverse to the machine running direction.

According to another aspect of the invention, there is provided a central component comprised of one of, a lower arm formed by the lower wall of the nozzle or the supporting plate allocated to it, an upper arm parallel to the central component, an inlet-side first central part and a second central part behind the first central part in the machine running direction. The upper arm and the two central parts arranged between the upper arm and the lower arm comprise supporting members of a turbulence generator.

According to one aspect of the invention, at least one stroke element, but no more than three stroke elements connect the transverse bar to the central component. Preferably, a single, or two stroke elements are provided. The at least one stroke element comprises a threaded spindle, or a hydraulic cylinder.

The individual supporting members extend at least to some extent vertically, and in a direction perpendicular to the upper wall of the nozzle. The individual supporting members comprise, at least partially, disks disposed in a direction parallel to the machine running direction. The transverse bar comprises a sheet metal standing on its edge. Alternatively, the transverse bar may comprise a hollow beam.

The division of the supporting elements and the supporting members is defined by the distances from one of, element or member center to, one of, element or member center, and is equal to the division of the segments of the central component.

According to the invention, a headbox for a paper-making machine comprises a nozzle extending transversely to a machine running direction across a machine width. The nozzle has a lower and an upper continuous wall, each extending across the machine width. A central component comprised of one of, a lower arm formed by the lower wall of the nozzle or the supporting plate is allocated to it. An upper arm on the central component, extends in a direction parallel to the central component. There is further provided an inlet-side first central part on the central component and a second central part behind the first central part in the machine running direction. The upper arm and the two central parts between the upper arm and the lower arm comprise supporting members of a turbulence generator, the upper arm and the second central part being each segmented in a direction transverse to the machine running direction to define segments thereon. The inlet-side first central part and the lower wall on the nozzle are each continuous in a direction transverse to the machine running direction.

The lower wall on the nozzle wall is moveable on a stationary supporting plate in the machine running direction and the stationary supporting plate is segmented transversely to the machine running direction. The headbox further comprises a hinge, the upper wall on the nozzle being pivotable on the hinge around an axis extending transversely to the machine running direction. A continuous hinge bearing, extending transversely to the machine running direction, is provided on a rear end of the upper arm of the central component in the machine running direction. The hinge bearing has a material reduction in the area between the individual segments of the adjacent upper arm.

According to one aspect of the invention, the division of the segments of the upper arm of the central component defined by the distances from segment center to segment center is approximately equal to the division of the segments of the second central part of the central component.

According to the invention, a headbox, for a paper-making machine, comprises a nozzle extending transversely to a machine running direction across a machine width. The nozzle has a lower and an upper continuous wall, each extending across the machine width. Several separate supporting elements distributed across the machine width, on a foundation, support the lower wall on the nozzle. The supporting elements are non-rigid. At least one of, a diagonal brace or transverse brace are provided between successive supporting elements in a center area, as viewed in a direction transverse to the machine running direction. The upper wall of the nozzle is pivotable around a swivel axis extending transversely to the machine running direction. A transverse bar is attached above the swivel axis. Several separate supporting members are distributed across the machine width. The supporting members connect the upper wall with the transverse bar. The supporting members are non-rigid. A central component comprised of one of, a lower arm formed by the lower wall of the nozzle or the supporting plate is allocated to the nozzle. There is further provided an upper arm parallel to the central component, an inlet-side first central part and a second central part behind the first central part in the machine running direction. The upper arm and the two central parts arranged between the upper arm and the lower arm comprise supporting members of a turbulence generator. At least one stroke element connects the transverse bar to the central component.

Further, according to the invention, there is provided a headbox for a paper-making machine comprising a nozzle extending transversely to a machine running direction across a machine width. The nozzle has a lower and an upper continuous wall, each extending across the machine width. A central component comprised of one of, a lower arm formed by the lower wall of the nozzle or the supporting plate is allocated to it. An upper arm on the central component, extends in a direction parallel to the central component. An inlet-side first central part is provided on the central component. A second central part is located behind the first central part in the machine running direction. The upper arm and the two central parts between the upper arm and the lower arm comprise supporting members of a turbulence generator, the upper arm and the second central part being each segmented in a direction transverse to the machine running direction to define segments thereon. The inlet-side first central part and the lower wall on the nozzle, are each continuous in a direction transverse to the machine running direction. The upper wall on the nozzle is pivotable on a hinge around an axis extending transversely to the machine running direction. A continuous hinge bearing, extending transversely to the machine running direction, is provided on a rear end of the upper arm of the central component in the machine running direction.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
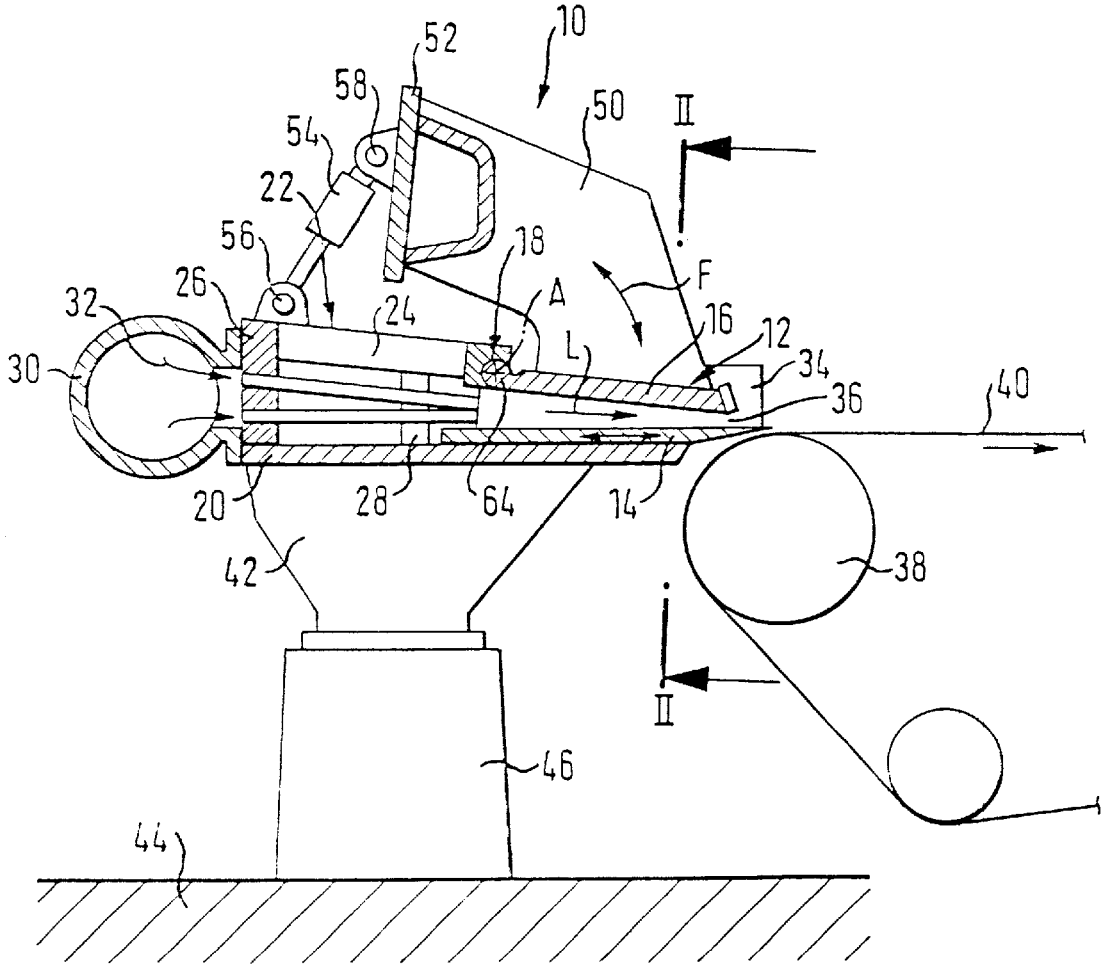
FIG. 1 shows a schematic partial section of a side view of a first embodiment of a headbox for an endless wire former.
Figure 2:
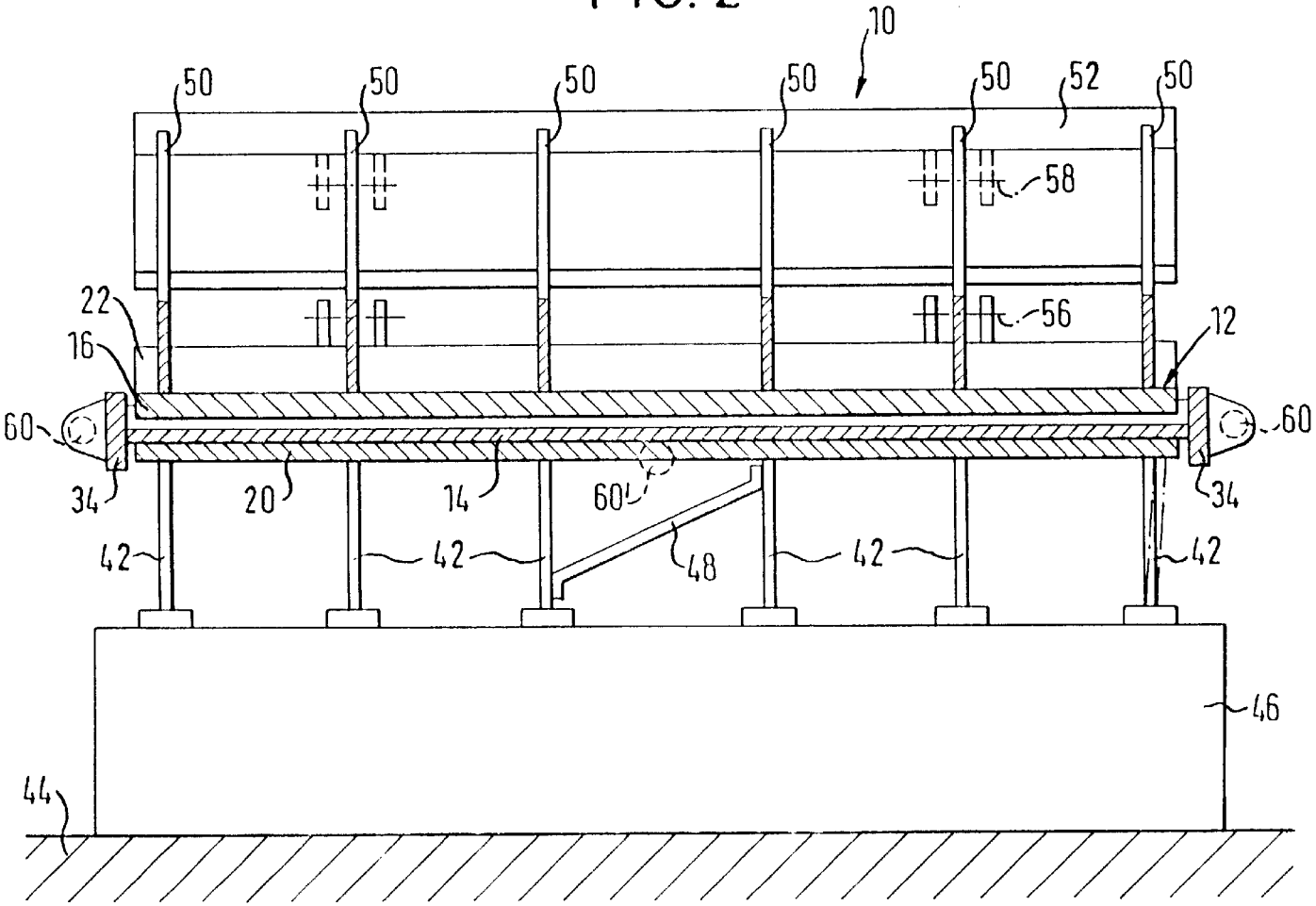
FIG. 2 is a schematic sectional representation of the headbox cut along Line II—II in FIG. 1.

FIGS. 1 and 2 show a purely schematic representation of a first embodiment of a headbox 10 for an endless wire former of a paper machine.

The headbox 10 includes a nozzle 12, extending transverse to the machine running direction L across the machine width, with a lower and an upper continuous wall 14 and 16 each extending across the machine width. In the present exemplary embodiment, the upper nozzle wall 16 can be swiveled by a hinge 18 around an axis A extending transverse to the machine running direction L. In addition, in the case at hand, the lower nozzle wall 14 can be displaced on a stationary supporting plate 20 in the machine running direction L.

A central component 22 of the headbox 10 includes a lower arm formed in the present embodiment by the supporting plate 20, an upper arm 24 that is preferably at least essentially parallel to it, an upstream first central part 26 and a second central part 28 further behind it in the machine running direction L or downstream. In this connection, the upper arm 24 and the two central parts 26, 28 arranged between this upper arm and the lower arm 20 preferably form supporting members of a turbulence generator. In the case of a non-displaceable, lower nozzle wall formed as one piece with the supporting plate, this lower nozzle wall or a corresponding section thereof can be added to the central component 22.

The fiber suspension 32 is fed to the central component 22 by a lateral distributing pipe 30, for example.

In the present exemplary embodiment, the central component 22, which is constructed as a turbulence generator, is provided with several graduated diffusers or with continuously variable turbulence pipes. The flow is guided to an outlet gap 36 by way of the lower nozzle wall 14 and the upper nozzle wall 16 as well as the lateral delimitations 34, such as side shields or the like, for example. The material stream that corresponds to the machine width exiting from the outlet gap 36 reaches the area of the breast roll 38 on a continuously circulating screen belt 40.

The stationary supporting plate 20 for the lower nozzle wall 14 or a stationary nozzle wall is supported by several separate supporting elements 42 distributed across the machine width on a foundation 44. The supporting elements 42 are designed to be non-rigid or flexible to bending transverse to the machine running direction L.

As can be seen in FIG. 2 in particular, the individual supporting elements extend at least to some extent generally vertically, i.e., perpendicular to the lower nozzle wall 14 or the supporting plate 20. In the case at hand, these supporting elements 42 are formed by disks (i.e. plates) parallel to the machine running direction L. However, they can also be formed by stud bolts or the like, for example.

In the present exemplary embodiment, the supporting elements 42 are connected to the foundation 44 by a pedestal 46 made of concrete, for example. Basically, these supporting elements 42 can also be connected directly to the foundation 44, however. The supporting elements 42 are each connected to the supporting plate 20 on the other end. In the case of a non-displaceable lower nozzle wall formed as one piece with the supporting plate, the supporting elements would be connected with the non-displaceable lower nozzle wall.

According to FIG. 2, a diagonal brace 48 is provided between the two center supporting elements 42, as viewed transverse to the machine running direction L. As can be seen, a transverse bar connected directly to the supporting plate 20 is missing. Accordingly, a heating system to compensate for the thermal bending of the supporting plate 20 or the nozzle wall 14 could also be eliminated. Heating devices (not shown) to change the height of at least one of the supporting elements 42 are conceivable, if need be, and namely in the case of a deformation of the foundation 44 or the pedestal 46 (which is hardly to be expected, however).

The upper nozzle wall 16 that can be swiveled around lateral axis A by way of the hinge 18 is connected by several separate supporting members 50 distributed across the machine width with a transverse bar 52 attached above the swivel axis A. These supporting members 50 are again designed to be non-rigid or flexible to bending transverse to the machine running direction L.

As can be seen in FIG. 2, the individual supporting members 50 extend vertically, i.e., perpendicular to the upper nozzle wall 16. In the current exemplary embodiment, the individual supporting members 50 are again formed by disks (i.e. plates) parallel to the machine running direction L.

Sheet metal standing on edge or a hollow beam can be provided as the transverse bar 52, for example (see FIG. 1 in particular).

One or more stroke elements 54 are coupled by way of an articulated axis 56 or 58 with the central component 22 on one side and with the traverse bar 52 on the other side. Thus, the upper nozzle wall 16 can be swiveled around the axis A in the direction of the arrow F (see FIG. 1) by these stroke elements 54. In the case of the stroke elements 54, one can be dealing with threaded spindles, hydraulic cylinders and/or the like, for example.

Stroke elements 60 are again provided for the linear displacement of the lower nozzle wall 14. In the case at hand, the drive for the lower nozzle wall 14 can take place by two hydraulic cylinders 60 and a linear stroke flow divider provided on two opposite sides, such as those marketed by the company Jahns-Regulatoren GmbH. One or two additional hydraulic cylinders can be provided in the center area in the case of greater machine widths.

Figure 3:
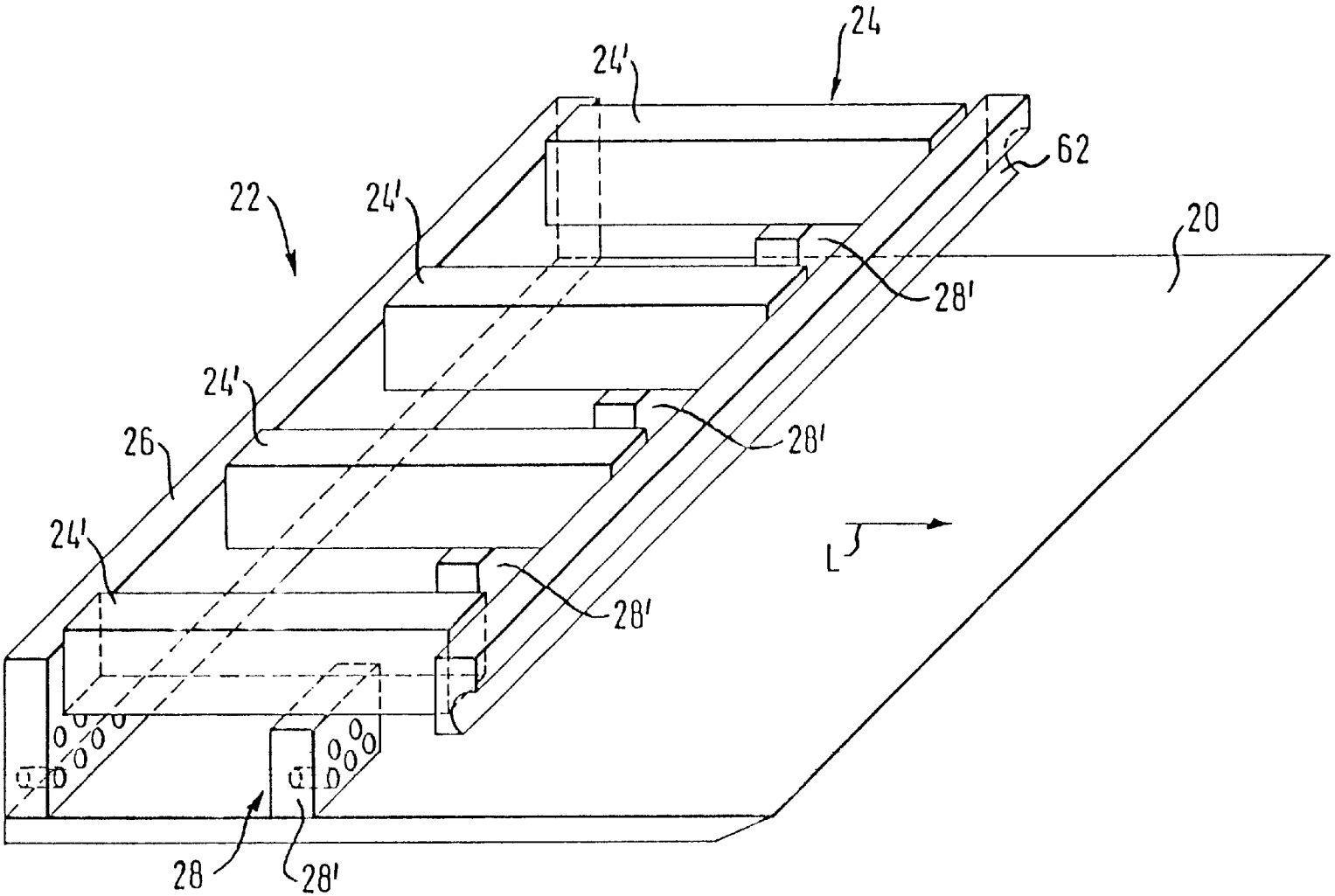
FIG. 3 is a schematic perspective representation of the central component of a headbox whose lower nozzle wall cannot be displaced.
Figure 4:
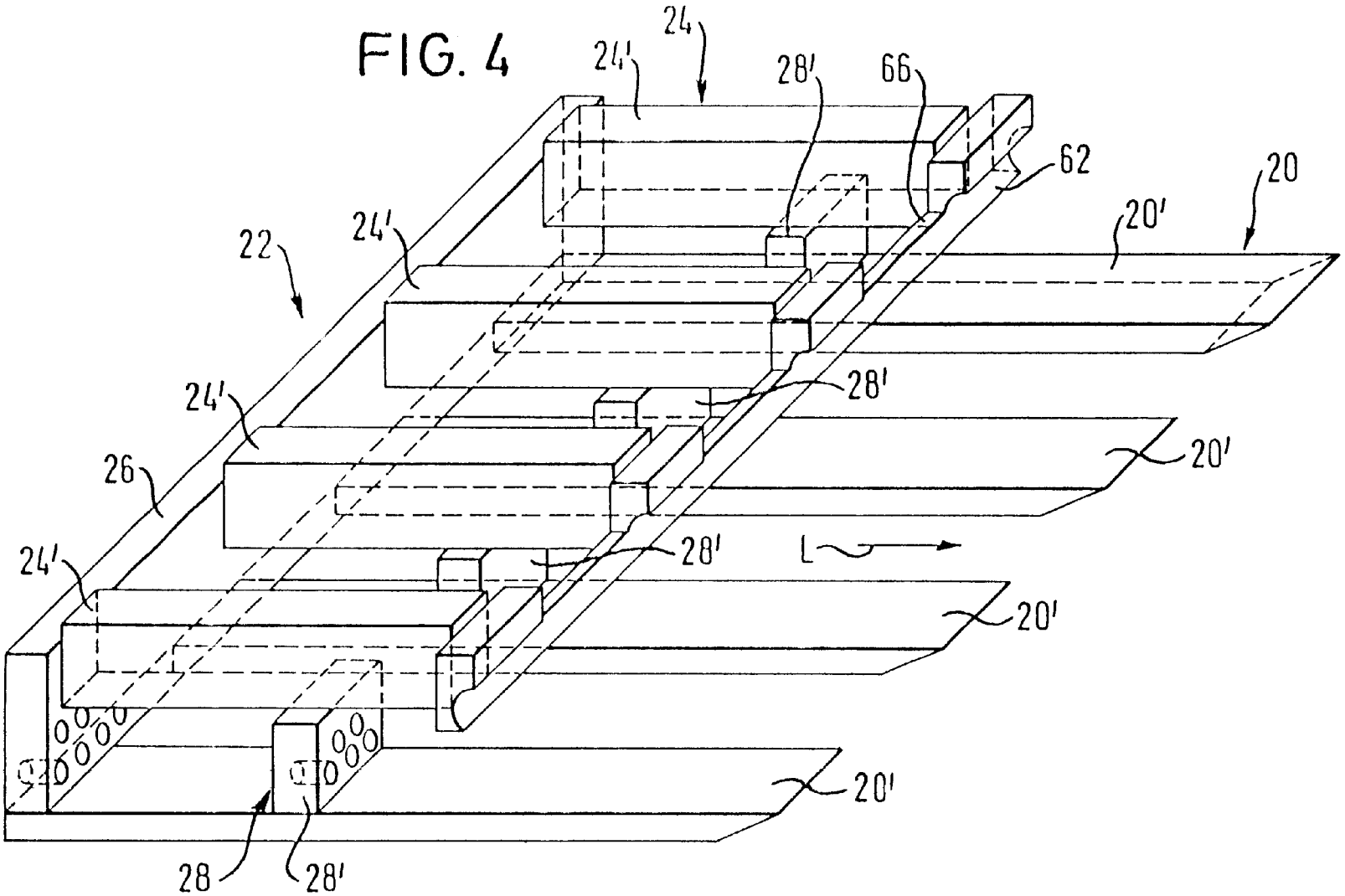
FIG. 4 is a schematic perspective representation of the central component of a headbox with a lower nozzle wall that can be displaced in the machine running direction.

As can be seen FIGS. 3 and 4 in particular, the upper arm 24 and the rear second central part 28 of the central component 22 in machine running direction L are each segmented transverse to the machine running direction L. On the other hand, the inlet-side first central part 26 of the central component 22 and the supporting plate 20 for the displaceable lower nozzle wall 14 are each designed to be continuous transverse to the machine running direction L.

FIG. 3 shows a schematic perspective representation of the central component 22 of a headbox. If the lower wall 14 (see FIG. 1) is not displaceable, it can be designed to be a single piece together with the supporting plate 20.

FIG. 4 again shows a schematic perspective representation of the central component of a headbox provided for a lower nozzle wall 14 (omitted from FIG. 4) that is displaceable in the machine running direction L on a stationary supporting plate 20 (also see FIGS. 1 and 2). In this case, the stationary supporting plate 20 is also segmented transverse to the machine running direction L.

In both of the cases depicted in FIGS. 3 and 4, a central component 22 is thus formed by a partially segmented C-shaped clamp. Hydrostatic pressure acting on the nozzle wall 14 and 16 results in tensile forces which pass through the segments 28' of the second central part 28, and pressure forces which pass through the first central part 26.

A continuous hinge bearing 62 of the hinge 18 (see also FIG. 1) extending transverse to the machine running direction L is provided on the rear end of the upper arm 24 of the central component 22 in the machine running direction L, into which a counter element 64 (see FIG. 1) provided on the upper nozzle wall 16 engages.

In the embodiment depicted in FIG. 3, the hinge bearing 62 has a constant cross-section transverse to the machine running direction L. However, the hinge bearing in the case of the central component 22 shown in FIG. 4 always has a material reduction 66 in the area between the individual segments 24' of the adjacent upper arm 24. It is also conceivable, for example, for the hinge bearing 62 to be composed of a continuous lower part and of several (therefore segmented) upper parts according to FIG. 4.

The division of the segments 24' of the upper arm 24 of the central component 22 defined by the distances from segment center to segment center is equal in both the embodiments depicted in FIGS. 3 and 4 to the division of the segments 28' of the rear second central part 28 of the central component in the machine running direction L.

In addition, in the case at hand, the division of the supporting elements 42 and the supporting members 50 defined by the distances from element or member center to element or member center is equal to the division of the segments 20', 24', 28' of the central component 22.

As can be seen in FIGS. 3 and 4, the segments 24' and 28' of the central component 22 are provided in the form of individual blocks distributed across the machine width. This also applies (in the case of FIG. 4) to the upper parts of the hinge bearing 62.

Figure 5:
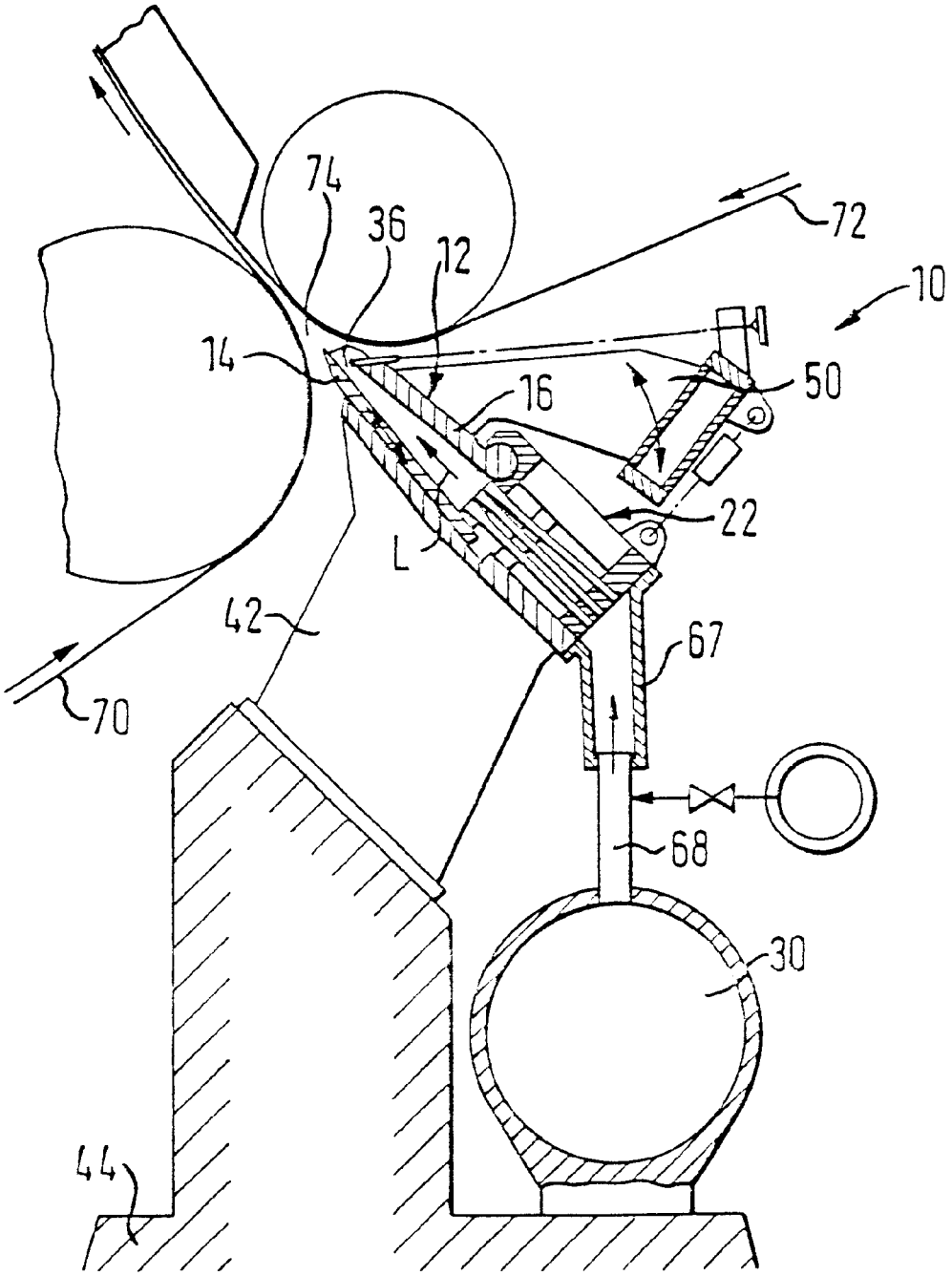
FIG. 5 is a schematic partial section of a side view of another embodiment of a headbox for a twin wire former.

FIG. 5 shows a schematic partial section of a side view of another embodiment of a headbox 10 for a twin wire former.

In this case, the fiber suspension is fed to an admission part 67 connected in series with the central component 22 by way of line 68 and the lateral distributing pipe 30 such that a consistency regulator sectioned transverse to the machine running direction L can be provided. The material stream in the machine width exiting from the outlet gap 36 reaches an inlet gap 74 formed between two screen belts 70, 72.

While the headbox 10 in the exemplary embodiments shown in FIGS. 1 and 2 is oriented essentially horizontally, the headbox 10 in the embodiment depicted in FIG. 5 is oriented with its outlet gap 36 diagonally upwards in the inlet gap 74 formed between the two screen belts 70, 72.

Otherwise, this headbox 10 again has at least essentially the same structure as the exemplary embodiments according to FIGS. 1 through 4.

The previous features described on the basis of exemplary embodiments can be realized individually or in any arbitrary combination. Thus, for example, only the solution in which the lower nozzle wall is provided with separate supporting elements can be realized, or only the one in which the upper nozzle wall is provided with separate supporting members. Even a type of embodiment is conceivable in which only the design of the central component as a partially segmented C-shaped clamp is provided, for example. In any case, any combination of just two of these three solutions is also conceivable. Finally, all three solutions can also be realized simultaneously.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Headbox
12 Nozzle
14 Lower nozzle wall
16 Upper nozzle wall
18 Hinge
20 Stationary supporting plate, lower arm
22 Central component
24 Upper arm
24' Segments
26 Inlet-side first central part
28 Rear second central part
28' Segments
30 Lateral distributing pipe
32 Fiber suspension
34 Lateral delimitation
36 Outlet gap
38 Breast roll
40 Screen belt
42 Supporting elements
44 Foundation
46 Base plate, pedestal
48 Diagonal brace
50 Supporting members
52 Traverse bar
54 Stroke element
56 Articulated axis
58 Articulated axis
60 Stroke element
60' Stroke element
62 Hinge bearing
64 Counter element
66 Material reduction
67 Admission part
68 Line
70 Screen belt
72 Screen belt
74 Inlet gap

What is claimed is:

1. A headbox, for a paper-making machine, comprising:

a nozzle extending transversely to a machine running direction across a machine width;

the nozzle having a lower and an upper continuous wall, each extending across the machine width;

a foundation;

several separate supporting elements distributed across the machine width on said foundation for supporting the lower wall on said nozzle;

said supporting elements being non-rigid or flexible plates which are bendable in a direction which is transverse to the machine running direction.

2. The headbox according to claim 1, wherein the supporting elements extend at least to some extent vertically, and perpendicularly to the lower nozzle wall.

3. The headbox according to claim 1, wherein the supporting elements are connected directly to the foundation.

4. The headbox according to claim 1, wherein the supporting elements are connected to the foundation by at least one of, a base plate or a pedestal.

5. The headbox according to claim 1, wherein the supporting elements are connected to the lower wall of said nozzle.

6. The headbox according to claim 1, wherein the lower wall of the nozzle is moveable on a stationary supporting plate in the machine running direction and the supporting elements are connected to the supporting plate.

7. The headbox according to claim 1, further comprising:

at least one of, a diagonal brace or transverse brace provided between successive supporting elements in a center area, as viewed in a direction transverse to the machine running direction.

8. The headbox according to claim 1, wherein the upper wall of the nozzle is pivotable around a swivel axis extending transversely to the machine running direction, and further comprising:

a transverse bar attached above the swivel axis;

several separate supporting members distributed across the machine width;

said supporting members connecting the upper wall with said transverse bar;

said supporting members being non-rigid.

9. The headbox according to claim 8, wherein the supporting members are flexible to permit bending in a direction transverse to the machine running direction.

10. The headbox according to claims 8, wherein the individual supporting members extend at least to some extent vertically, and in a direction perpendicular to the upper wall of the nozzle.

11. The headbox according to claim 8, wherein the individual supporting members comprise, at least partially, plates disposed in a direction parallel to the machine running direction.

12. The headbox according to claim 8, wherein the transverse bar comprises a sheet metal standing on its edge.

13. The headbox according to claim 8, wherein the transverse bar comprises a hollow beam.

14. A headbox, for a paper-making machine, comprising:

a nozzle extending transversely to a machine running direction across a machine width;

the nozzle having a lower and an upper continuous wall, each extending across the machine width;

a foundation;

several separate supporting elements distributed across the machine width on said foundation for supporting the lower wall on said nozzle;

said supporting elements being non-rigid;

wherein the upper wall of the nozzle is pivotable around a swivel axis extending transversely to the machine running direction, and further comprising:

a transverse bar attached above the swivel axis;

several separate supporting members distributed across the machine width;

said supporting members connecting the upper wall with said transverse bar;

said supporting members being non-rigid;

the headbox further comprising:

a central component comprised of a lower arm formed by one of the lower wall of the nozzle or a supporting plate allocated to the lower wall of the nozzle;

an upper arm parallel to said central component;

an inlet-side first central part;

a second central part behind the first central part in the machine running direction;

the upper arm and the two central parts arranged between the upper arm and the lower arm comprising supporting members of a turbulence generator; and at least one stroke element connecting the transverse bar to the central component.

15. The headbox according to claim 14, wherein there are a maximum of three stroke elements.

16. The headbox according to claim 14, wherein there is provided a single stroke element.

17. The headbox according to claim 14, wherein there are provided two stroke elements.

18. The headbox according to claim 14, wherein sa id at least one stroke element comprises a threaded spindle.

19. The headbox according to claim 14, wherein said at least one stroke element comprises a hydraulic cylinder.

20. The headbox according to claim 14, wherein the division of the supporting elements and the supporting members defined by the distances from one of, element or member center to, one of, element or member center, is equal to the division of the segments of the central component.

21. A headbox for a paper-making machine, comprising:

a nozzle extending transversely to a machine running direction across a machine width;

the nozzle having a lower and an upper continuous wall, each extending across the machine width;

a central component comprised of a lower arm formed by one of the lower wall of the nozzle or a supporting plate allocated to the lower wall of the nozzle;

an upper arm on the central component, extending in a direction parallel to said central component;

an inlet-side first central part on the central component;

a second central part behind the first central part in the machine running direction;

the upper arm and the two central parts between the upper arm and the lower arm comprising supporting members of a turbulence generator, the upper arm and the second central part being each segmented in a direction transverse to the machine running direction to define segments thereon; and the inlet-side first central part and the lower wall on the nozzle being each continuous in a direction transverse to the machine running direction.

22. The headbox according to claim 21, wherein the lower wall on the nozzle wall is moveable on a stationary supporting plate in the machine running direction and the stationary supporting plate is segmented transversely to the machine running direction.

23. The headbox according to claim 21, further comprising:

a hinge;

the upper wall on the nozzle being pivotable on said hinge around an axis extending transversely to the machine running direction; and a continuous hinge bearing, extending transversely to the machine running direction, being provided on a rear end of the upper arm of the central component in the machine running direction.

24. The headbox according to claim 23, wherein the hinge bearing has a material reduction in the area between the individual segments of the adjacent upper arm.

25. The headbox according to claim 21, wherein the division of the segments of the upper arm of the central component defined by the distances from segment center to segment center is approximately equal to the division of the segments of the second central part of the central component.

26. A headbox, for a paper-making machine, comprising:

a nozzle extending transversely to a machine running direction across a machine width;

the nozzle having a lower and an upper continuous wall, each extending across the machine width;

a foundation;

several separate supporting elements distributed across the machine width on said foundation for supporting the lower wall on said nozzle;

said supporting elements being non-rigid;

at least one of, a diagonal brace or transverse brace being provided between successive supporting elements in a center area, as viewed in a direction transverse to the machine running direction;

the upper wall of the nozzle being pivotable around a swivel axis extending transversely to the machine running direction, and further comprising:

a transverse bar attached above the swivel axis;

several separate supporting members distributed across the machine width;

said supporting members connecting the upper wall with said transverse bar;

said supporting members being non-rigid;

a central component comprised of a lower arm formed by one of the lower wall of the nozzle or a supporting plate allocated to the lower wall of the nozzle;

an upper arm parallel to said central component;

an inlet-side first central part;

a second central part behind the first central part in the machine running direction;

the upper arm and the two central parts arranged between the upper arm and the lower arm comprising supporting members of a turbulence generator; and at least one stroke element connecting the transverse bar to the central component.

27. A headbox for a paper-making machine, comprising:

a nozzle extending transversely to a machine running direction across a machine width;

the nozzle having a lower and an upper continuous wall, each extending across the machine width;

a central component comprised of a lower arm formed by one of the lower wall of the nozzle or a supporting plate allocated to the lower wall of the nozzle;

an upper arm on the central component, extending in a direction parallel to said central component;

an inlet-side first central part on the central component;

a second central part behind the first central part in the machine running direction;

the upper arm and the two central parts between the upper arm and the lower arm comprising supporting members of a turbulence generator, the upper arm and the second central part being each segmented in a direction transverse to the machine running direction to define segments thereon; and the inlet-side first central part and the lower wall on the nozzle being each continuous in a direction transverse to the machine running direction;

a hinge;

the upper wall on the nozzle being pivotable on said hinge around an axis extending transversely to the machine running direction; and a continuous hinge bearing, extending transversely to the machine running direction, being provided on a rear end of the upper arm of the central component in the machine running direction.

* * * * *